United States Patent [19]

Copp

[11] Patent Number: 4,893,994

[45] Date of Patent: Jan. 16, 1990

[54] GUIDE ASSEMBLY AND GUIDE SHOE FOR A VARIABLE ANGLE WOBBLE PLATE COMPRESSOR

[75] Inventor: Carl A. Copp, Vandalia, Ohio

[73] Assignee: General Motors Corporation, Detroit, Mich.

[21] Appl. No.: 356,494

[22] Filed: May 25, 1989

[51] Int. Cl.[4] ..... F04B 1/14

[52] U.S. Cl. ..... 417/269; 74/60

[58] Field of Search ..... 417/269; 92/12.2, 187; 384/206, 207; 403/122, 124, 127, 131, 135, 141; 91/472, 499; 74/60

[56] References Cited

U.S. PATENT DOCUMENTS 4,178,136 12/1979 Reid et al. ..... 417/269

4,815,943 3/1989 Kawashima et al. ..... 417/269

*Primary Examiner*—John J. Vrablik

*Assistant Examiner*—John A. Savid, III

*Attorney, Agent, or Firm*—Ronald L. Phillips

[57] ABSTRACT

An improved guide assembly, including a guide bearing and a pair of guide shoes, for a variable displacement wobble plate compressor is disclosed. The guide shoes include a body portion and positioning lugs that extend outwardly therefrom and arcuately around the guide bearing. The body portion engages the bearing and positioning lugs terminate in bearing edge surfaces. The lugs extend around the guide bearing such that said bearing surfaces are in close juxtaposition for load bearing contact. During operation, as compressor loading increases, the loading on the guide shoes from the wobble plate increases as well. This higher loading, and the tendency for uneven loading, brings the edge surfaces of the positioning lugs into load bearing contact. This serves to equalize the loading and substantially prevent relative guide shoe motion and frictional line contact with the guide rod. Thus, undesirable excess wear due to frictional contact of the guide shoes and the guide rod is avoided. The lugs are preferably 35%–45% of the width of the body portion.

4 Claims, 2 Drawing Sheets

GUIDE ASSEMBLY AND GUIDE SHOE FOR A VARIABLE ANGLE WOBBLE PLATE COMPRESSOR

TECHNICAL FIELD

The present invention relates to variable displacement axial compressors, and more particularly, to an improved guide assembly and guide shoe for such compressor providing increased efficiency of operation and service life of the compressor.

BACKGROUND OF THE INVENTION

A variety of refrigerant compressors for use in vehicle air conditioning systems are currently available. A popular vehicle compressor design is the variable displacement axial type. In this type compressor, a number of cylinders are equally angularly spaced about and equally radially spaced from the axis of a central drive shaft. A piston is mounted for reciprocal sliding motion in each of the cylinders. A piston rod connects each piston to a swash plate or wobble plate received about and operatively connected to the drive shaft. During operation of the compressor, rotation of the drive shaft imparts a radial reciprocating motion to the wobble plate. This driving of the wobble plate in a nutating path about the drive shaft serves to impart a linear reciprocating motion to the pistons. By varying the angle of the wobble plate relative to the drive shaft, the stroke of the pistons and, therefore, the displacement or capacity of the compressor may be varied to effect the desired compressing action.

One of the most efficient and successful vehicle refrigerant compressors of the variable displacement axial type in use today is that disclosed in U.S. Pat. No. 4,480,964 to Skinner, issued Nov. 6, 1984. During operation of this compressor, rotary motion from the engine is imparted to the compressor drive shaft through an external pulley. The compressor drive shaft is operatively connected to a journal plate assembly that imparts the linear, reciprocating motion to the pistons. The journal plate assembly includes a rotating driving plate and a non-rotating wobble plate in sliding engagement. The wobble plate is prevented from rotating by its engagement with a stationary guide rod aligned parallel to the axis of the drive shaft.

More specifically, the wobble plate engages the guide rod through a guide assembly including a spherical guide bearing mounted upon the guide rod and a pair of guide shoes. The guide shoes slidingly engage the outer peripheral surface of the guide bearing while resting in a slot having opposed semi-cylindrical bearing surfaces provided within the wobble plate. During compressor operation, the guide bearing reciprocates along the guide rod, while the guide shoes rock back and forth over the guide bearing. Thus, the radial-reciprocating motion of the wobble plate is accomodated by the action of the guide rod, the guide bearing and the guide shoes, assuring that only the desired back and forth motion is imparted to the pistons.

While this prior art compressor has proved very effective, there is some need for improvement. More specifically, under certain operating conditions and especially at higher speeds and loads, one of the guide shoes may be subjected to a disproportionately higher load than the other shoe. Such uneven loading serves to force the guide shoes to move relative to one another. More specifically, edges of the loaded shoe, and to a lesser extent the relatively unloaded shoe, may in fact be brought into frictional engagement with the guide rod in a line of contact. This frictional engagement reduces the operating efficiency of the compressor. Further, under certain operating conditions the engagement results in an undesirable increase in guide shoe wear. A need exists therefore for an improved guide assembly for a variable angle wobble plate compressor exhibiting improved wear characteristics.

SUMMARY OF THE INVENTION

It is therefore a primary object of the present invention to provide an improved guide assembly for a wobble plate compressor that exhibits reduced guide shoe wear during operation and thus, provides for increased service life.

Another object of the present invention is to provide improved guide shoes for a variable angle wobble plate compressor that substantially reduces or eliminates frictional contact between the guide shoes and the guide rod.

Yet another object of the present invention is to provide a new guide assembly to redistribute the load on the guide shoes so as to substantially eliminate line contact between the shoes and the guide rod for improved efficiency and reduced wear. Advantageously, the new assembly may be utilized without modification of the existing compressor design.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, an improved guide assembly and guide shoe for a variable angle wobble plate compressor is provided.

In its broadest aspects, the improvement of the present invention relates to the structure of the guide shoes of the guide assembly. More specifically, the guide shoes are each provided with a pair of opposed positioning lugs extending in a winged fashion from a central body portion. The positioning lugs are provided to maintain the guide shoes in a substantially firm, centered position upon the opposed, operative surfaces of the guide bearing. In this way the guide shoes are prevented from contacting the guide rod and causing wear problem. As described in greater detail below, this results not only in reduced guide shoe wear, but also improved compressor operation due to the reduced frictional contact.

Reference is directed to U.S. Pat. No. 4,480,964 to Skinner entitled "Refrigerant Compressor Lubrication System", issued Nov. 6, 1984. This reference discloses the preferred embodiment of the variable angle wobble plate compressor in which the improved guide shoes of the present invention may be installed.

More specifically, the variable angle wobble plate compressor includes a cylinder block including five axially aligned cylinder bores. Five pistons are slidingly engaged for reciprocal motion within these cylinder bores. The reciprocating action of the pistons is utilized to compress the refrigerant. The compressed refrigerant is then further utilized by the air conditioning system to condition the air being directed to the vehicle interior before cycling back to the compressor.

A central drive shaft is axially aligned within the cylinder block. The drive shaft extends a distance outside the cylinder block and is attached to a pulley. As is well known in the art, the pulley is connected by a fan belt to the vehicle engine whereupon the engine imparts a rotary motion to the pulley and the drive shaft to operate the compressor.

A journal plate assembly is attached to the drive shaft in a variable angle relation. As the drive shaft rotates, the journal plate assembly imparts a reciprocating motion to the pistons within the cylinder bores. The total stroke of the pistons is dependent on the angle of the journal plate assembly, and can be varied between zero and full stroke by simply changing the angle to adapt the compressor output to the system requirements.

The journal plate assembly includes a rotating driving plate and a non-rotating wobble plate. The wobble plate is prevented from rotating along with the drive plate by a stationary guide rod. As the driving plate rotates, it imparts the nutating motion to the wobble plate. Since the pistons are connected to the wobble plate, only the desirable back and forth or linear reciprocating motion is imparted to the pistons.

The wobble plate engages the guide rod through a guide assembly including a spherical guide bearing and a pair of guide shoes mounted thereon. The combination of the guide bearing and the guide shoes provides the desired freedom of motion to the wobble plate. More specifically, the wobble plate undergoes combined longitudinal and arcuate travel relative to the guide rod. Being slidingly engaged on the guide rod, the guide bearing takes up the longitudinal travel. The arcuate travel of the wobble plate is accomodated by the substantially semi-circular guide shoes mounted in a sliding relationship upon the guide bearing.

According to an important aspect of the present invention, a pair of positioning lugs are provided on each guide shoe. The distal ends of the lugs terminate in a rectangularly shaped contact area or load bearing edge. When assembled, the positioning lugs of the guide shoes extend towards one another around the guide bearing. A relatively small clearance is provided between the ends of the positioning lugs to allow limited relative motion.

As compressor speeds and/or loading increases, the loading forces imparted to the guide shoes by the wobble plate also increase. Loading forces, however may increase in a disproportionately higher amount on one of the shoes depending on the direction of rotational movement of the driving plate. This uneven loading causes the shoes to shift relative to one another. In the past, it has been found that where this uneven loading and relative shifting movement becomes extreme, the edge of the shoe with the higher loading tends to engage the guide rod thereby causing undesirable frictional contact and wear. The uneven loading and relative shifting movement is, however, limited in the present invention and thus, these problems are substantially avoided.

More specifically, after a relatively small shifting movement, the positioning lugs of the newly designed guide shoes contact one another. This contact between the juxtaposed bearing edges of the lugs substantially prevents further relative motion between the guide shoes. The contact also serves to substantially equalize the loading on each shoe so that excessive force is not exerted along the edge of one shoe against the guide rod. Thus, undesirable frictional contact between an edge of the body portion of the guide shoes and the guide rod often found in prior art designs is substantially avoided. Thus, improved operating efficiency is attained and increased compressor service life is assured.

In the preferred embodiment, the width of the contact area or bearing edge surface is between approximately 35–45% the width of the guide shoe. Through experimentation, it has been determined that the provision of a bearing edge having a width approximately 40% the width of the guide shoe provides the most satisfactory results.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWING

The accompanying drawing incorporated in and forming a part of the specification, illustrates several aspects of the present invention and together with the description serves to explain the principles of the invention. In the drawing.

Reference will now be made in detail to the present preferred embodiment of the invention, an example of which is illustrated in the accompanying drawing.

DETAILED DESCRIPTION OF THE INVENTION

Figure 1:
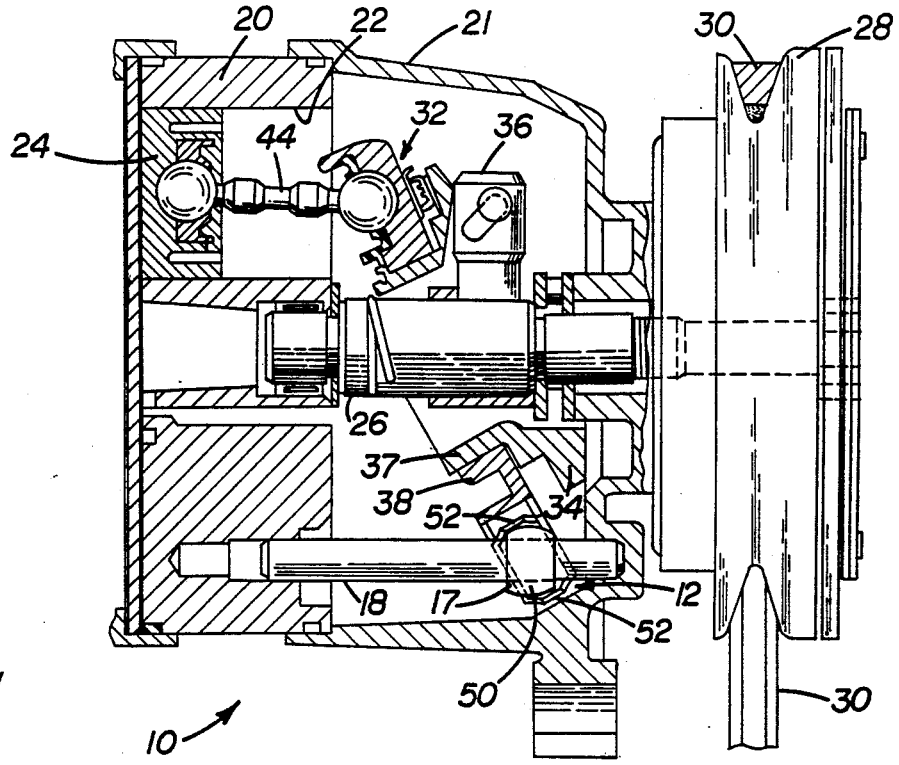
FIG. 1 is a partial cross sectional view of the variable displacement wobble plate compressor including the improved guide assembly of the present invention.

Reference is made to FIG. 1 illustrating in cross section a variable displacement or angle wobble plate compressor 10 including an improved guide assembly 12 constructed in accordance with the teachings of the present invention. As should be appreciated from a review of the following description, the guide assembly 12 of the present invention improves compressor efficiency and reduces guide shoe wear during compressor operation. These advantages result from reduced frictional contact between the guide shoes 14 of the guide assembly 12 and the guide rod 18 on which the assembly travels.

As is known in the art and shown, for example, in U.S. Pat. No. 4,480,964 to Shinner, the variable angle wobble plate compressor 10 includes a cylinder block 20 including five axially aligned cylinder bores 22 (only one shown in FIG. 1). A piston 24 is slidingly engaged for reciprocal motion within each of the cylinder bores 22. The reciprocating action of the pistons 24 is utilized to compress the refrigerant. The compressed refrigerant is discharged from the discharge port (not shown) of the compressor 10 where it is utilized by the air conditioning system to condition air being directed to the vehicle interior. The "spent" refrigerant is then returned to the compressor 10 through a suction port (not shown) to complete the cycle.

A central drive shaft 26 is axially aligned within the cylinder block 20 and a crankcase 21. The drive shaft 26 extends externally from the crankcase 21 and is attached to a pulley 28. A fan belt 30 is attached to the pulley 28 and to the engine (not shown). During engine operation, the fan belt 30 transmits power from the engine to the pulley 28 and the drive shaft 26 to drive the compressor 10.

A journal plate assembly 32 is provided for receiprocating the pistons 24. The journal plate assembly 32 includes a rotary driving plate 34 that is attached to a driving lug 36 connected to the drive shaft 26. Thus, the driving plate 34 is rotated with the drive shaft 26.

The driving plate 34 includes a journal 37 on which a non-rotary wobble plate 38 is mounted. The wobble plate 38 is prevented from rotating by its connection to the stationary guide rod 18. More specifically, the wobble plate 38 includes a slot 40 in which the improved guide shoes 14 of the present invention are received. The guide shoes 14 are positioned in substantially opposing relation and each includes a body portion 15. Each body portion 15 includes a recess 16 that slidingly engages and rides on an operative face of the guide bearing 17 that is received about the guide rod 18.

As the drive shaft 26 is driven, the driving plate 34 is rotated. This in turn imparts a nutating motion to the non-rotary wobble plate 38; the precise path of which is determined by the angle of the journal plate assembly 32 to the drive shaft 26. More specifically, when the journal plate assembly 32 is positioned at a maximum angle as shown in FIG. 1, the nutating motion is exaggerated., Thus, through the connection of the pistons 24 to the wobble plate 38 by means of the rod 44, it should be appreciated that the pistons are then reciprocated through their full stroke. As a result, the compressor 10 operates at maximum capacity. Conversely, when the journal plate assembly 32 is adjusted so as to be perpendicular to the drive shaft 26, the driving plate 34 spins freely without imparting motion to either the wobble plate 38 or the pistons 24. Thus, the operation of the compressor 10 is effectively terminated in this position. Of course, by varying the angle of the journal plate assembly 32 anywhere between these two extremes operation of the compressor 10 at an infinite number of intermediate capacity levels may be achieved as desired.

Figure 3:
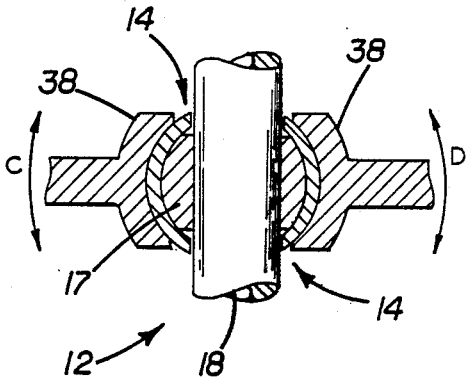
FIG. 3 is a cross sectional view taken along section line 3—3 of FIG. 2.
Figure 4:
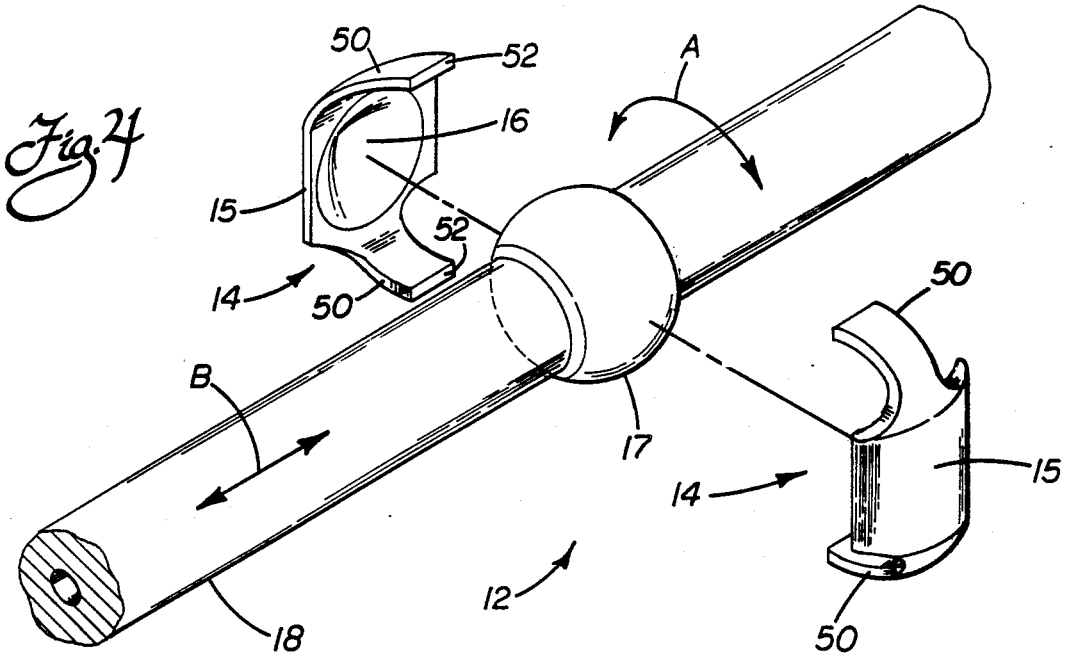
FIG. 4 is an exploded perspective view of the guide bearing and guide shoes of the present invention.
Figure 5:
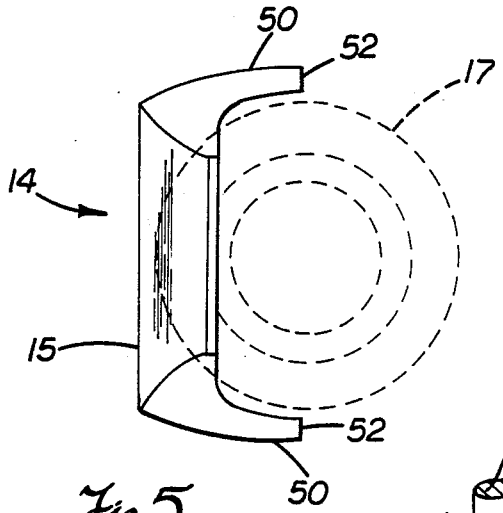
FIG. 5 is an end view of the improved guide shoe of the present invention, the guide bearing being shown in phantom.
Figure 6:
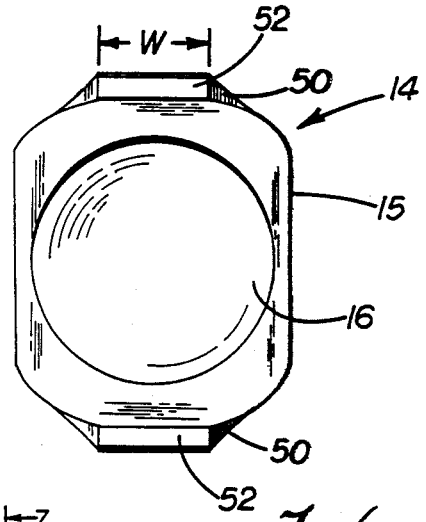
FIG. 6 is a side view of the improved guide shoe of the present invention, showing the bearing edge surfaces of a positioning lug.

As the wobble plate 38 travels along its nutating path, it moves with respect to the guide rod 18 by reciprocating both arcuately (i.e. about the rod) and longitudinally (i.e. along the rod) (note action arrows A and B, respectively, in FIG. 4). The wobble plate 38 also moves arcuately about the guide bearing 17 against the semi-cylindrical outside of the guide shoes 14 which are in spherical contact with the guide bearing 17 (see action arrows C and D in FIG. 3). The arcuate motion of the wobble plate 38 against the guide shoes 14, in the high speed, high load condition is what forces the edge of the higher loaded guide shoe 14 into movable live contact against the guide rod. The guide assembly 12 is designed to accomodate this motion. More specifically, the guide bearing 17 slides back and forth along the guide rod 18 to allow for the longitudinal reciprocating motion. The guide shoes 14 ride back and forth over the guide bearing 17 to accomodate the arcuate reciprocating motion.

During operation of prior art compressors, it has been found that under certain operating conditions including relatively high loading and operating speeds, one of the guide shoes 14 tends to carry a disproportionately high load. The particular shoe in question is determined by the direction in which the compressor drive shaft 26 is being driven. This disproportionate loading causes the lead edge of the higher loaded shoe 14 to engage the guide rod 18 under force as the guide bearing 17 reciprocates longitudinally along the guide rod and the shoe reciprocates arcuately around the guide bearing. The end result of this frictional engagement is a drag on compressor efficiency and in certain instances excessive guide shoe wear. Advantageously, this problem is addressed and resolved by utilizing the improved guide shoes 14 of the present invention.

As shown in FIGS. 4–7, the improved guide shoes 14 each include a pair of positioning lugs 50 that extend like wings from the body portion of guide shoes and along the operative face of the guide bearing 17. The positioning lugs 50 are provided to distribute the load evenly over the guide shoes 14 and thereby maintain their relative positions even under the most severe compressor operating conditions. This is accomplished by providing load bearing contact through rectangular bearing edge surfaces 52 provided at the distal end of each lug 50.

Figure 2:
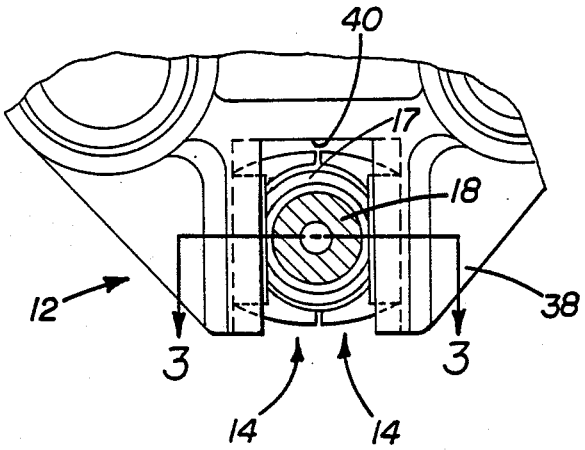
FIG. 2 is a partial plan view of the wobble plate showing the guide bearing and the improved guide shoes of the present invention.
Figure 7:
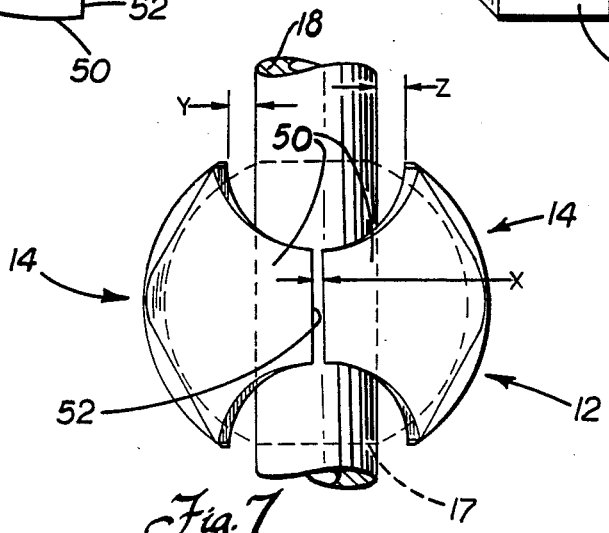
FIG. 7 is a top elevational view showing the two guide shoes in the assembled position about the guide rod, the guide bearing being shown in phantom.

When assembled as best shown in FIGS. 2 and 7, the bearing edge surfaces 52 of the opposed guide shoes 14 are closely juxtapositioned. Thus, in the event uneven loading causes a slight shift in the relative positions of the shoes 14 on the guide bearing 17, the juxtaposed bearing edge surfaces 52 along one side or the other are brought into engagement. This engagement serves to redistribute the loading over both shoes 14 so as to be more evenly shared. It also limits the relative movement of the shoes 14 on the guide bearing 17 and substantially prevents the lead edge the body portion 15 of either of the shoes 14 from engaging the guide rod 18 under force. As a result, friction is reduced and compressor efficiency is proportionately increased. In addition, guide shoe wear is also reduced.

In the preferred embodiment, the width of each bearing edge surface 52 is between approximately 35–45% the width of the guide shoe 14. Still more preferably, it has been determined that the provision of a bearing edge surface 52 having a width approximately 40% the width of the guide shoe 14 provides the most satisfactory results.

By design, referring to FIG. 7, clearance X is made less than clearances Y and Z to assure that bearing edge surfaces 52 will always be in contact before the sides of the guide shoes 14 can contact the guide rod 18. This allows the redistribution of the loading referred to above.

In summary, numerous benefits are obtained by use of the present invention. The variable angle wobble plate compressor 10 includes the improved guide assembly 12 of the present invention. During compressor operation, the wobble plate motion is taken up by the combined action of the guide shoes 14, the guide bearing 17 and the guide rod 18. The positioning lugs 50 contact one another through the bearing edge surfaces 52 to equalize the loading and prevent undesirable line contact wear along the edges of the body portion 15 of the guide shoes 14 against the guide rod 18. Thus, both improved operational efficiency and increased service life are virtually assured.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as is suited to the particular use contemplated. All such modifications and variations are within the scope of the invention as determined by the appended claims when interpreted in accordance with breadth to which they are fairly, legally and equitably entitled.

I claim:

1. An improved guide assembly for a variable displacement axial compressor, said compressor including a wobble plate and a stationary guide rod in operative engagement with said wobble plate for preventing rotation of said wobble plate, comprising:

guide bearing means slidingly engaged on said guide rod; and at least a pair of guide shoes for engaging said wobble plate, said guide shoes being slidably mounted on said guide bearing means, said guide shoes further including positioning means having substantially juxtaposed bearing surfaces for distributing load and substantially maintaining the relative position of said guide shoes during compressor operation;

whereby guide shoe friction and wear against the guide rod is prevented and an increase in efficiency of the compressor is provided.

2. An improved guide assembly for a variable displacement axial compressor, as provided in claim 1, wherein said positioning means includes positioning lugs extending along the operative face of said guide bearing means, said load bearing surfaces comprising the distal edges of said lugs, said bearing edge surfaces further being of a width of substantially 35–45% of the width of said guide shoes.

3. In a variable displacement wobble plate axial compressor, comprising a cylinder block; a drive shaft rotatable in said cylinder block; a cylinder in said block arranged substantially parallel to the axis of said shaft; a piston for sliding reciprocal movement in said cylinder bore; a journal plate assembly including a driving plate and wobble plate for operatively connecting said piston to said drive shaft; and a guide rod substantially parallel to the axis of said drive shaft, connected to said cylinder block;

the improvement comprising a guide assembly for operatively connecting said wobble plate of said journal plate assembly to said guide rod, said guide assembly including a guide bearing slidingly engaged upon said guide rod and a pair of substantially opposed guide shoes, said guide shoes being mounted in said wobble plate and upon said guide bearing, said guide shoes further including positioning means having substantially juxtaposed bearing surfaces;

whereby, during operation of said compressor, as said wobble plate is driven along a nutating path said juxtaposed bearing surfaces distribute load between said guide shoes and limit relative motion therebetween thereby substantially preventing frictional contact between said guide rod and said guide shoes.

4. An improved guide shoe for guiding the wobble plate of a variable displacement wobble plate compressor over a guide bearing on a guide rod, comprising:

a body portion including a recess for slidingly engaging said guide bearing;

a pair of substantially opposed positioning lugs extending from said body portion along the operative face of said guide bearing; and a load bearing edge surface provided at a distal end of each positioning lug for engagement with each other during operation;

whereby guide shoe friction and wear against the guide rod is prevented and an increase in efficiency of the compressor is provided.

* * * * *